United States Patent [19]

Leftin et al.

[11] 4,176,045

[45] Nov. 27, 1979

[54] PYROLYSIS COKE INHIBITION

[75] Inventors: Harry P. Leftin; David S. Newsome, both of Houston, Tex.

[73] Assignee: Pullman Incorporated, Chicago, Ill.

[21] Appl. No.: 923,519

[22] Filed: Jul. 10, 1978

[51] Int. Cl.[2] ..... C10G 9/16; C07C 11/04

[52] U.S. Cl. ..... 208/48 R; 208/130; 585/648; 585/950

[58] Field of Search ..... 208/48 AA, 48 R, 130; 260/683 R

[56] References Cited

U.S. PATENT DOCUMENTS

| | | | |
|---|---|---|---|
| 2,621,216 | 12/1952 | White | 260/683.3 |
| 3,437,714 | 4/1969 | Newman | 260/683 R |
| 3,536,776 | 10/1970 | Lo | 260/683 R |
| 3,842,138 | 10/1974 | Chahvekilian et al. | 260/683 R |

OTHER PUBLICATIONS

Green et al., (Stone & Webster), "Olefins Production by Gas Oil Cracking", Hydrocarbon Processing, Sep. 1975, pp. 164–168.

*Primary Examiner*—Delbert E. Gantz
*Assistant Examiner*—G. E. Schmitkons

[57] ABSTRACT

In the production of lower olefins by steam cracking normally liquid hydrocarbons at very short residence times, the formation of coke deposits in cracking furnace tubes is minimized by the addition of a low-coking hydrocarbon to fresh feed having a high coking tendency.

6 Claims, 2 Drawing Figures

PYROLYSIS COKE INHIBITION

Figure 1:
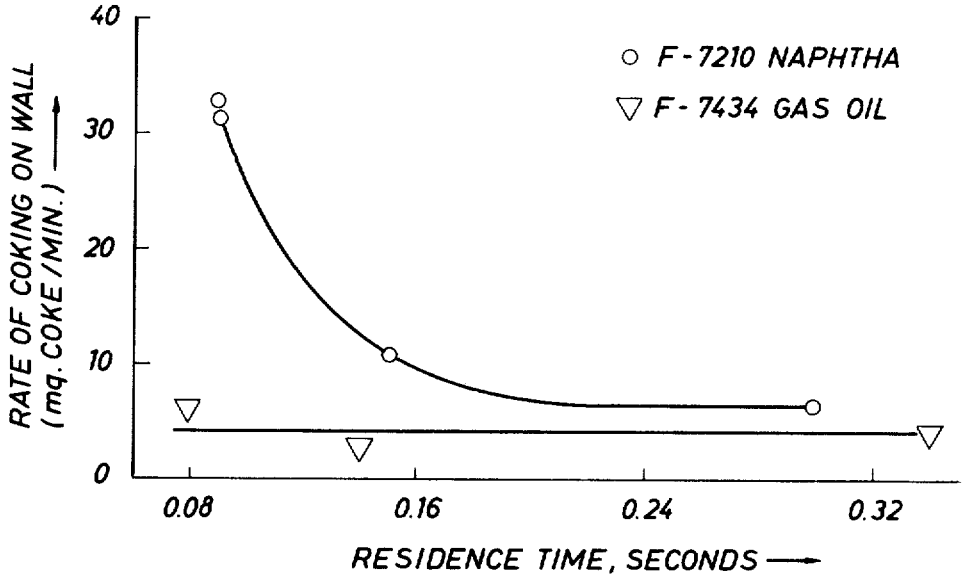

This invention relates to the production of $C_2$–$C_5$ olefins by steam pyrolysis, ie,-cracking, of normally liquid hydrocarbons in a tubular furnace and, more particularly, relates to the minimization of coincident coke deposits on the interior surface of the furnace tubes.

It is known that carbonaceous materials, generally in the form of coke, deposit on the inside walls of tubes of fired, tubular furnaces used in steam cracking. In time, these deposits reach sufficient thickness to seriously retard heat transfer, increase pressure drop through the furnace tubes, and eventually require furnace decoking by known means such as steam and/or air decoking. A discussion of surface coking mechanisms at elevated temperatures may be found in Catalyst Reviews—Science and Engineering, Vol. 16, No. 2, pp. 173–180 (1977).

Efforts to increase furnace run length time, that is, the operating period between decoking intervals, have led to experimentation with several techniques directed to minimization of coke formation and deposition. Among these are addition to the cracking feedstock of controlled amounts of, variously, sulfur, hydrogen, hydrogen sulfide, nitrogen oxides, catechols, potassium compounds, or phosphorus compounds. Some of these additives ostensably act upon the hydrocarbon or the coke precursors therein. Others are utilized as catalyst poisons against a perceived tendency of some furnace tube constituents, notably nickel, to catalyze coke reactions. On the other hand, many furnace operators rely on the use of large steam excesses since steam has the known effect of altering the carbon equilibrium.

It is accepted that coke deposition rates increase with increasing operating temperature which, in turn, is necessitated by currently favored increases in cracking depth or severity. The significance of feedstock character with respect to coke deposition rate is less clear. The art has often associated heavy feedstocks with increasingly severe coking rates. That is to imply that the coking rate for vacuum gas oil is higher than that for naphtha which, in turn, is higher than that for ethane. This view is not completely supported by commercial experience. More recently it has been suggested that coking tendency is in part a function of feedstock aromaticity. Accordingly, the more highly aromatic a feedstock may be, eg.—gas oil, the less suitable it is for cracking feedstock. (See Green, Zdonik, Hallee, Olefins Production by Gas Oil Cracking, Hydrocarbon Processing, September, 1975, p. 164.)

We have now found that, with respect to normally liquid hydrocarbons, feedstock character is a very important variable in the rate of coke deposition on furnace tube wall interiors within the regime of very short residence time cracking. By very short residence time we refer to pyrolysis carried out from about 0.02 seconds to about 0.20 seconds and preferably, for optimized conversion to ethylene, from about 0.05 to about 0.15 seconds. Within these ranges of contact or residence time, we have also found that normally liquid hydrocarbon feedstocks may be categorized according to low, moderate, or severe tendencies to deposit coke on the interior surface of radiant furnace tubes. Additionally, we have found that feedstocks having high coking tendencies are quite sensitive to increasing pyrolysis temperature and decreasing residence time. Correspondingly, feedstocks having low coking tendencies exhibit little or no sensitivity to pyrolysis temperature and residence time. From the foregoing, we surmise that some virgin and non-virgin cracking feedstocks contain one or more natural coke inhibitors or, perhaps, groups of inhibitors. The concentration of these inhibitors appears to vary throughout various distillate cuts of low coking feedstocks.

The feedstock characterizations, ie.—low, moderate, or severe coking tendency have been found to be a multidependent function of specific gravity, sulfur content, and aromaticity as expressed by the U.S. Bureau of Mines Correlation Index (BMCI). In general, low coking feedstocks are characterized by low sulfur, high specific gravity, and high aromaticity. The latter is most surprising since heavily aromatic feedstocks are believed to cause rapid rates of coke formation. The characterizations may be more specifically expressed by use of a Coking Inhibition Index (CII) that we have empirically derived where:

$$CII = 153.4 - \left[ 5.1\sqrt{BMCI}\,(1 + \frac{S}{1.3}) + 2API \right] \quad (1)$$

and where:

$$BMCI = \frac{48640}{VABP} + 473.7(SG) - 456.8^{\circ} \quad (2)$$

$VABP$ = volume average boiling point (°K.)
$SG$ = specific gravity (15.6° C./15.6° C.)
$S$ = weight percent sulfur $$API = \frac{141.5}{SG} - 131.5 \quad (3)$$

With the calculated Coking Inhibition Index (CII), one may reasonably well predict the coking propensities of various virgin and non-virgin, normally liquid, hydrocarbon feedstocks. A feed having a high CII will have less tendency to deposit coke than one having a low CII. In general, we find that feedstocks having a CII greater than about 10 have low coking tendencies.

According to the invention, blends of low-coking, normally liquid hydrocarbon having a CII greater than about 10 with a higher-coking, normally liquid hydrocarbon having a CII less than about 10 result in a blended feedstock having a coking tendency which closely approaches that of the low-coking hydrocarbon.

The inhibiting portion of the blended feedstock, that is the weight percent of low-coking hydrocarbon in the blended feedstock required to attain the described effect, is dependent on the average of the individual Coking Inhibition Indeces (CII) of the blend components, and the minimum inhibiting portion equals one hundred divided by the arithmetical average of the Coking Inhibition Indeces of the blended feedstock components.

$$\text{Minimum inhibiting portion (weight \%)} = \frac{100}{\text{Average } CII} \quad (4)$$

It is apparent that the minimum inhibiting portion expressed as weight percent of the blended liquid feedstock can vary considerably according to the respective indices (CII) of the blend components. These may vary from below minus twenty (−20) for a severely coking feed to above fifty (+50) for a hydrocarbon having a very low coking tendency. As previously mentioned, a low coking feed will have a CII above about 10. A normally liquid blended feedstock having an arithmetrical average CII above about 1, preferably above about 5, can be expected to have low coking tendency when more than the minimum inhibiting portion of low coking hydrocarbon is incorporated in the blended feedstock.

To illustrate, two feedstocks identified in Table 1, items 1 and 7 as F7210 and F7434 have Coking Inhibition Indices (CII) of −21.1 and +44.4 respectively. F7210 is a severe coking hydrocarbon and F7434 is a low coking hydrocarbon. The arithmetical average CII of the two feedstocks is +11.6, and according to equation (4), the minimum inhibiting portion of F7434 necessary for a blend of the two feedstocks to have a low coking tendency is 8.6 weight percent.

Figure 2:
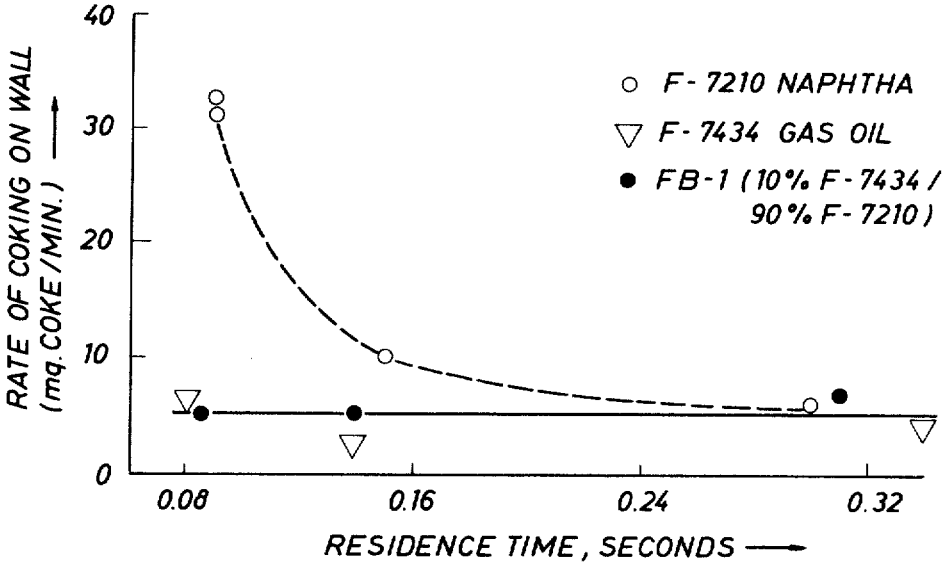

FIGS. 1 and 2 portray graphically the rate of coke deposition on the interior surface of a pyrolysis tube wall expressed as a function of cracking residence time for the above-mentioned feedstocks at a fluid outlet temperature of 888° C. The data portrayed was developed in accordance with Example 1, later described.

Referring to FIG. 1, the coking tendency of F7210 at very short residence times is seen to be quite high as predicted by the calculated CII of −21.1. The coking tendency of F7434 under the same pyrolysis conditions is relatively quite low, again, as predicted by a calculated CII of +44.4

Referring to FIG. 2, it may be seen that a 10% by weight blend of F7434 into F7210 results in a blended feedstock having nearly the same low coking tendency as the inhibiting feedstock F7434. Again, the low coking tendency is predicted by the Average CII of 11.6 and the calculated minimum inhibiting portion of 8.6 weight percent.

In one embodiment of the invention, a normally liquid hydrocarbon derived from crude oil and having a CII less than about 10 is blended with at least a minimum inhibiting portion of another normally liquid hydrocarbon derived from crude oil and having a CII greater than about 10 and the blended feedstock is cracked at very short residence time under steam pyrolysis conditions to produce olefinic effluent.

In another embodiment of the invention, a normally liquid hydrocarbon derived from crude oil and having a CII less than about 10 is blended with at least a minimum inhibiting portion of a distillate fraction of another normally liquid hydrocarbon derived from crude oil and having a CII greater than about 10 and the blended feedstock is cracked at very short residence time under steam pyrolysis conditions to produce olefinic effluent.

In another embodiment of the invention a normally liquid hydrocarbon derived from crude oil and having a CII less than about 10 is blended with from about 5 to 20 weight percent of gas oil having a boiling point between about 200° C. and about 565° C. and having a CII greater than about 30 and the blended feedstock is cracked at very short residence times under steam pyrolysis conditions to produce olefinic effluent.

In a preferred embodiment of the invention, a normally liquid hydrocarbon such as naphtha having a boiling point between $C_5$ and about 225° C. and a CII less than about 10 is utilized as fresh pyrolysis feedstock. Naphtha, despite its high tendency to deposit coke is nevertheless a desirable feedstock because of its high yields of olefins, particularly ethylene, when cracked under high severity conditions. In this embodiment, naphtha is blended with at least a minimum inhibiting portion of pyrolysis oil having a boiling point of from about 200° C. to about 500° C. and a CII greater than about 10. The pyrolysis oil is a fraction recovered from an olefins-containing pyrolysis effluent and is preferably derived from the fresh feed naphtha.

The process of the invention may be carried out in a tubular cracking furnace having the capability of very short residence time cracking. The furnace described in U.S. Pat. No. 3,671,198 is exemplary of this type. Cracking temperatures employed are from about 815° C. to about 955° C. (fluid temperature) measured at the outlet of the tubular furnace. Specific cracking temperatures are selected generally according to the ethylene yield desired from a given feedstock. The pressure at which cracking is carried out is not critical within the limits of customary commercial practice and furnace outlet pressures may range from about 1.5 kg/cm$^2$ absolute to about 5.0 kg/cm$^2$ absolute. Other aspects of steam cracking conditions commonly employed in the art have been found not to be critical in carrying out the process of the invention. For example, steam to hydrocarbon weight ratio of the blended feedstock may range from about 0.1 to about 1.5 although a ratio of from about 0.4 to about 1.0 is preferred for carrying out very short residence time cracking. Similarly, we have found no criticality with respect to furnace tube material or size except to the extent that selections are suitable for elevated temperature service and very short residence time cracking. Typically, high-nickel, high-chromium, steel furnace tubes from about 2 cm to about 6 cm diameter may be employed. We have found no adverse effect on product yields in carrying out the process of the invention.

EXAMPLE 1

Liquid feedstocks and water were separately metered from pressurized feed tanks into a preheater-vaporizer and finally into a pyrolysis reactor contained in an electrically heated furnace. The reaction zone was an annulus between a 0.683 cm inside diameter outer pipe and a 0.476 outside diameter inner tube which served as the thermocouple well. Both tubes were AISI type 310 stainless steel for most of the runs. Gases leaving the reaction zone were rapidly cooled by admixture with a recycled stream of cooled product gas. Furnace temperature was raised to run conditions with steam and nitrogen flowing through the reactor. Final adjustment to the final fluid outlet temperature desired was made with feed and water at the required flow rates. Runs were carried out with dilution steam to hydrocarbon weight ratio of about 0.5 at the fluid outlet temperatures shown in the following tables and were essentially isobaric at a total pressure of 2.1 kg/cm$^2$.

Prior to each run, the oxidized reactor wall was treated with a mixture of hydrogen sulfide and hydrogen at 800° C. for 1½ hours and then treated with 500 ppm mercaptan water for ½ hour.

At the end of each run, carbon deposits in the reaction zone were burned off with air and total carbon evolution measured. The coking rate was then calculated by dividing carbon evolution by run length.

The results of this work relevant to the process of the invention are summarized in Tables 1 through 5 following.

Table 1 describes the unblended feedstocks utilized in the example and illustrates the general relationship between feedstock properties and coking behavior under very short residence time cracking conditions.

Tables 2 through 5 illustrate the coking behavior of particular high coking feedstocks in the neat (unblended) and blended state. Within each table, runs are grouped by fluid outlet temperature since temperature is an important variable in the coking rate. Tables 2 through 5 show that the coking rates of high-coking, normally liquid, hydrocarbon feedstocks may be decreased by the incorporation therein of a flow-coking, normally liquid hydrocarbon in accordance with the teachings of the invention. As described in the footnote (5) to Tables 2 through 5, runs marked in the last column with an asterisk indicate runs made in accordance with the process of the invention.

TABLE 1

FEEDSTOCK CHARACTERISTICS

| Item No. | Feed-stock | Description | Inspections: Spec Grav. | Inspections: Boiling Range °C. | Inspections: Sulfur Wt. % | Calculated Values: °API | Calculated Values: VABP °K. | Calculated Values: BMCI | Calculated Values: CII | Coking Rate in mg./minute (1): 871 °C. | 899 °C. | 927 °C. | Coking Tendency |
|---|---|---|---|---|---|---|---|---|---|---|---|---|---|
| 1 | F7210 | Light Naphtha | .666 | 46–69 | .014 | 80.9 | 330 | 6.1 | −21.1 | 20 | 42 | >90 (2) | Severe |
| 2 | F7227 | Raffinate | .686 | 61–137 | .010 | 74.9 | 355 | 5.2 | −8.1 | 20 | 32 | >70 (2) | Severe |
| 3 | F7313 | Naphtha | .699 | 37–196 | .019 | 71.0 | 362 | 8.6 | −3.8 | 7 | 16 | 32 | Moderate |
| 4 | F7138 | High-Sulfur Gas-Oil | .897 | 234–459 | 2.33 | 26.3 | 653 | 42.6 | +7.9 | 5 | 15 | 40 | Moderate |
| 5 | F7433 | Raffinate | .749 | 68–229 | .0008 | 57.4 | 388 | 23.4 | +13.9 | 5 | 5 | 5 | Low |
| 6 | F5714 | Kerosine | .822 | 167–252 | .13 | 40.7 | 483 | 33.2 | +39.7 | 5 | 5 | 5 | Low |
| 7 | F7434 | Gas Oil | .826 | 177–339 | .22 | 39.8 | 542 | 24.3 | +44.4 | 6 | 6 | 6 | Low |
| 8 | F7141 (3) | Gas Oil | .881 | 172–463 | .82 | 29.1 | 643 | 36.2 | +45.2 | 5 | 5 | 5 | Low |
| 9 | PFO | Pyrolysis Fuel Oil(4) | .994 | 218–427 | .74 | 10.8 | 579 | 98.3 | +52.5 | — | — | — | Low (5) |

FOOTNOTES TO TABLE 1:
(1) Values for smoothed curves of data at contact time of .08 seconds.
(2) Extrapolated values.
(3) Desulfurized F7138.
(4) Derived from steam cracking F7434.
(5) Based on blend data.

TABLE 2

F7210 (LIGHT NAPHTHA)

| Item No. | Temp. °C. (1) | Feed-stock | Run No. | Blending Stock | CII Average (2) | Min. wt. % Inh. (3) | Actual wt. % Inh. | Coke Rate mg./min. | Contact Time, Seconds | Run Length, Minutes (4) | (5) |
|---|---|---|---|---|---|---|---|---|---|---|---|
| 1. | 927 | Neat | — | — | −21.1 | — | 0 | >90 (6) | .08 | — | |
| 2. | " | FB4 | 1 | F7434 | +11.6 | 8.6 | 5 | 110.3 | .08 | 13 | |
| 3. | " | FB35 | 2 | F5714 | +9.3 | 10.8 | 10 | 66.7 | .08 | 24 | |
| 4. | " | FB1 | 3 | F7434 | +11.6 | 8.6 | 10 | 14.6 | .09 | 120 | * |
| 5. | 913 | Neat | 9 | — | −21.1 | — | 0 | 62.9 | .09 | 16 | |
| 6. | " | Neat | 16 | — | −21.1 | — | 0 | 41.8 | .08 | 24 | |
| 7. | " | FB4 | 3 | F7434 | +11.6 | 8.6 | 5 | 30.5 | .08 | 64 | |
| 8. | " | FB6 | 1 | F7141 | +12.05 | 8.3 | 10 | 10.7 | .08 | 120 | * |
| 9. | " | FB1 | 9 | F7434 | +11.6 | 8.6 | 10 | 3.9 | .08 | 120 | * |
| 10 | 899 | FB18 | 1 | Fract. 3 F7434 (7) | +12.1 (10) | 8.3 (10) | 4 | 56.9 | .08 | 17 | |
| 11 | " | Neat | 8 | — | −21.1 | — | 0 | 38.3 | .09 | 58 | |
| 12 | " | FB20 | 1 | Fract. 6 F7434 (7) | +27.5 (10) | 3.6 (10) | 1 | 36.1 | .08 | 19 | |
| 13 | " | FB19 | 1 | F7433 | −3.6 | 99+ | 10 | 35.3 | .08 | 28 | |
| 14 | " | FB22 | 1 | F7433 | −3.6 | 99+ | 90 | 29.6 | .08 | 14 | |
| 15 | " | Neat | 11 | — | −21.1 | — | 0 | 28.7 | .08 | 22 | |
| 16 | " | FB21 | 1 | F7433 | −3.6 | 99+ | 50 | 25.6 | .08 | 9 | |
| 17 | " | Neat | 13 | — | −21.1 | — | 0 | 21.0 | .08 | 120 (8) | |
| 18 | " | FB4 | 2 | F7434 | +11.6 | 8.6 | 5 | 13.3 | .09 | 120 | |
| 19 | " | FB8 | 3 | Fract. 6 F7434 (7) | +27.5 (10) | 3.6 (10) | 2 | 11.0 | .08 | 120 | |
| 20 | " | FB14 | 2 | Fract. 1 F7434 (7) | +1.1 (10) | 95.2 (10) | 4 | 10.5 | .08 | 58 | |
| 21 | " | FB61 | 2 | PFO(9) | +15.7 | 6.4 | 10 | 8.2 | .07 | 120 | * |
| 22 | " | FB1 | 2 | F7434 | +11.6 | 8.6 | 10 | 5.7 | .08 | 120 | * |
| 23 | " | FB15 | 1 | Fract. 6 F7434 (7) | +27.5 (10) | 3.6 (10) | 4 | 3.0 | .07 | 120 | * |
| 24 | 888 | Neat | 5 | — | −21.1 | — | 0 | 33.2 | .09 | 80 | |
| 25 | " | Neat | 3 | — | −21.1 | — | 0 | 32.2 | .09 | 41 | |
| 26 | " | Neat | 10 | — | −21.1 | — | 0 | 10.8 | .150 | 82 | |
| 27 | " | FB1 | 4 | F7434 | +11.6 | 8.6 | 10 | 7.2 | .310 | 120 | * |
| 28 | " | Neat | 7 | — | −21.1 | — | 0 | 6.6 | .300 | 120 | |
| 29 | " | FB1 | 1 | F7434 | +11.6 | 8.6 | 10 | 5.4 | .08 | 120 | * |

TABLE 2-continued

F7210 (LIGHT NAPHTHA)

| Item No. | Temp. °C. (1) | Feed-stock | Run No. | Blending Stock | CII Average (2) | Min. wt. % Inh. (3) | Actual wt. % Inh. | Coke Rate mg./min. | Contact Time, Seconds | Run Length, Minutes (4) | (5) |
|---|---|---|---|---|---|---|---|---|---|---|---|
| 30 | " | FB1 | 8 | F7434 | +11.6 | 8.6 | 10 | 5.0 | .14 | 120 | * |
| 31 | 871 | Neat | 4 | — | −21.1 | — | 0 | 7.8 | .09 | 93 | |
| 32 | " | Neat | 6 | — | −21.1 | — | 0 | 2.3 | .300 | | 120 |
| 33 | " | FB1 | 5 | F7434 | +11.6 | 8.6 | 10 | 2.1 | .33 | 120 | * |

TABLE 3

F7313 (NAPHTHA)

| Item No. | Temp. °C. (1) | Feed-stock | Run No. | Blending Stock | CII Average (2) | Min. wt. % Inh. (3) | Actual wt. % Inh. | Coke Rate mg./min. | Contact Time, Seconds | Run Length, Minutes (4) | (5) |
|---|---|---|---|---|---|---|---|---|---|---|---|
| 1 | 945 | Neat | — | — | −3.8 | — | 0 | >50 (6) | .08 | — | |
| 2 | " | FB3 | 3 | F7434 | +20.3 | 4.9 | 10 | 19.2 | .078 | 120 | * |
| 3 | " | FB3 | 2 | F7434 | +20.3 | 4.9 | 10 | 12.6 | .143 | 120 | * |
| 4 | 927 | Neat | 134 | — | −3.8 | — | 0 | 42.2 | ~.17 | 32 | |
| 5 | " | Neat | 136 | — | −3.8 | — | 0 | 33.8 | ~.20 | 22 | |
| 6 | " | Neat | 7 | — | −3.8 | — | 0 | 31.8 | ~.08 | 36 | |
| 7 | " | Neat | 133 | — | −3.8 | — | 0 | 24.8 | ~.18 | 50 | |
| 8 | " | Neat | 115 | — | −3.8 | — | 0 | 24.2 | ~.16 | 41 | |
| 9 | " | FB31 | 2 | F7433 | +5.1 | 19.8 | 20 | 12.5 | ~.08 | 120 | * |
| 10 | " | FB36 | 1 | F5714 | +17.9 | 5.6 | 10 | 7.5 | .076 | 121 | * |
| 11 | " | FB3 | 1 | F7434 | *20.3 | 4.9 | 10 | 7.4 | .149 | 120 | * |

TABLE 4

F7227 (RAFFINATE)

| Item No. | Temp. °C. (1) | Feed-stock | Run No. | Blending Stock | CII Average (2) | Min. wt. % Inh. (3) | Actual wt. % Inh. | Coke Rate mg./min. | Contact Time, Seconds | Run Length, Minutes (4) | (5) |
|---|---|---|---|---|---|---|---|---|---|---|---|
| 1 | 927 | Neat | — | — | −8.1 | — | 0 | >70 (6) | .08 | — | |
| 2 | " | FB5 | 1 | F7434 | +18.2 | 5.5 | 5.0 | 72.1 | ~.08 | 23 | |
| 3 | " | FB2 | 2 | F7434 | +18.2 | 5.5 | 10 | 9.9 | .082 | 120 | * |
| 4 | 889 | Neat | 4 | — | −8.1 | — | 0 | 26.6 | ~.08 | 76 | |
| 5 | " | FB5 | 2 | F7434 | +18.2 | 5.5 | 5.0 | 15.5 | .084 | 120 | |
| 6 | 899 | FB5 | 3 | F7434 | +18.2 | 5.5 | 5.0 | 11.8 | .082 | 120 | |
| 7 | 888 | FB2 | 1 | F7434 | +18.2 | 5.5 | 10 | 3.3 | .084 | 120 | * |
| 8 | 871 | Neat | 2 | — | −8.1 | — | 0 | 19.9 | ~.08 | 63 | |
| 9 | " | Neat | 1 | — | −8.1 | — | 0 | 16.3 | .166 | 120 | |
| 10 | 844 | Neat | 3 | — | −8.1 | — | 0 | 14.8 | ~.08 | 120 | |

TABLE 5

F7138(HIGH SULFUR GAS OIL)

| Item No. | Temp. °C. (1) | Feed-stock | Run No. | Blending Stock | CII Average (2) | Min. wt. % Inh. (3) | Actual wt. % Inh. | Coke Rate mg./min. | Contact Time, Seconds | Run Length, Minutes (4) | (5) |
|---|---|---|---|---|---|---|---|---|---|---|---|
| 1 | 927 | Neat | 2 | — | +7.9 | — | 0 | 46.2 | ~.09 | 53 | |
| 2 | " | Neat | 5 | — | +7.9 | — | 0 | 33.2 | ~.09 | 63 | |
| 3 | 929 | FB33 | 1 | F7434 | +26.2 | 3.8 | 6 | 10.3 | .084 | 120 | * |

FOOTNOTES TO TABLES 2-5:
(1) Control temperature of fluid at pyrolysis reactor tube outlet.
(2) Coking Inhibition Index of neat or blended feedstock.
(3) Calculated minimum volume percent of inhibiting portion in blended feedstock required for low coking rate.
(4) Normal run lengths are 120 minutes. Shorter run lengths indicate reactor tube plugging due to rapid coke deposit.
(5) *indicates runs made with more than the minimum volume percent of inhibiting blending stock.
(6) Could not be run because of very rapid coke deposit at temperature shown. Value shown is extrapolated.
(7) F7434 was separated into six fractions. Fraction 1 is the top cut, fraction 3 is a mid-fraction, and fraction 6 is the bottom cut.
(8) Very high pressure drop but reactor tube did not plug.
(9) Pyrolysis fuel oil separated from F7434 pyrolysis effluent.
(10) Calculated from estimated VABP.

We claim:

1. In a process for the production of olefins by steam pyrolysis of normally liquid hydrocarbon feedstock at a residence time of from about 0.02 to about 0.2 seconds in a tubular furnace wherein coke deposits on the interior surface of the furnace tubes, the improvement which comprises:

(a) blending an inhibiting portion of normally liquid hydrocarbon having a Coking Inhibition Index (CII) greater than about 10 into a steam pyrolysis feedstock having a CII less than about 10 to form a blended feedstock wherein the minimum inhibiting portion expressed as weight percent of the blended feedstock equals $$\frac{100}{\text{Average } CII} \text{ and}$$

Average $CII$ = Arithmetical Average of the Coking Inhibition Indeces ($CII$) of blended feedstock components $$CII = 153.4 - \left[ 5.1 \sqrt{BMCI} \left(1 + \frac{S}{1.3}\right) + 2API \right]$$

$$BMCI = \frac{48640}{VABP} + 473.7\,(SG) - 456.8$$

$VABP$ = volume average boiling point (°K.)
$SG$ = specific gravity (15.6° C./15.6° C.)
$S$ = weight percent sulfur $$API = \frac{141.5}{SG} - 131.5$$

(b) introducing the blended feedstock to the tubular furnace, and (c) recovering an olefins-containing effluent from the tubular furnace.

2. The process of claim 1 wherein pyrolysis is conducted at a residence time of from about 0.05 seconds to about 0.15 seconds and a fluid temperature of from about 815° C. to about 955° C. measured at the outlet of the tubular furnace.

3. The process of either claim 1 or claim 2 wherein at least part of the inhibiting portion of normally liquid hydrocarbon is a distillate fraction of another liquid hydrocarbon.

4. The process of either claim 1 or claim 2 wherein at least part of the inhibiting portion of normally liquid hydrocarbon is pyrolysis oil recovered from an olefins-containing pyrolysis effluent.

5. The process of claim 1 wherein the inhibiting portion of normally liquid hydrocarbon is gas oil having a Coking Inhibition Index greater than about 30 and constitutes from about 5 to about 20 weight percent of the blended feedstock.

6. The process of claim 1 wherein steam pyrolysis is carried out at a pressure of from about 1.5 kg/cm$^2$ absolute to about 4.0 kg/cm$^2$ absolute and a steam weight ratio of from about 0.1 to about 1.5.

* * * * *